US008032056B2

(12) United States Patent
Lee et al.

(10) Patent No.: US 8,032,056 B2
(45) Date of Patent: Oct. 4, 2011

(54) DEVELOPING UNIT AND IMAGE FORMING APPARATUS HAVING THE SAME

(75) Inventors: Sang Hoon Lee, Suwon-si (KR); Jong In Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/628,427

(22) Filed: Dec. 1, 2009

(65) Prior Publication Data

US 2010/0158576 A1 Jun. 24, 2010

(30) Foreign Application Priority Data

Dec. 22, 2008 (KR) ..... 10-2008-0131667

(51) Int. Cl.
*G03G 21/18* (2006.01)

(52) U.S. Cl. ..... 399/113

(58) Field of Classification Search ..... 399/113, 399/111

See application file for complete search history.

(56) References Cited

U.S. PATENT DOCUMENTS

| | | | | |
|---|---|---|---|---|
| 6,101,350 | A * | 8/2000 | Suzuki et al. | 399/113 |
| 6,173,140 | B1 | 1/2001 | Suzuki et al. | |
| 6,721,520 | B2 * | 4/2004 | Higeta et al. | 399/113 X |
| 7,747,192 | B2 * | 6/2010 | Sato | 399/111 |
| 2002/0106213 | A1 | 8/2002 | Higeta et al. | |
| 2005/0008394 | A1 | 1/2005 | Ishii et al. | |
| 2006/0285880 | A1 * | 12/2006 | Okabe | 399/111 |
| 2008/0310881 | A1 * | 12/2008 | Sato | 399/111 |

FOREIGN PATENT DOCUMENTS

| | | |
|---|---|---|
| EP | 0 866 387 | 9/1998 |
| EP | 1 217 468 | 6/2002 |
| EP | 1 496 409 | 1/2005 |
| JP | 09-026740 | 1/1997 |

OTHER PUBLICATIONS

English language abstract of JP 09-026740, published Jan. 28, 1997.
Machine English language translation of JP 09-026740, published Jan. 28, 1997.
European Search Report issued in EP 09177030.5, mailed Mar. 17, 2010.

* cited by examiner

*Primary Examiner* — Sophia S Chen
(74) *Attorney, Agent, or Firm* — Stanzione & Kim, LLP

(57) ABSTRACT

Disclosed are a developing unit and an image forming apparatus having the same. The developing unit includes a first frame and a second frame. The first frame supports thereon a first set of processing members and includes at least one jig hole for mounting to a jig. The second frame supports thereon a second set of processing members. Several connection parts provided in the first and second frames allow assembly of the developing unit that includes a rectilinear movement and a rotational movement of the first and second frames relative to each other during the coupling together of the connection parts so as to couple the first and second frames together. The relative movement in certain direction of the frames may be limited during the relative rotational movement of the frames.

25 Claims, 7 Drawing Sheets

DEVELOPING UNIT AND IMAGE FORMING APPARATUS HAVING THE SAME

CROSS-REFERENCE TO RELATED APPLICATION

This application claims the benefit of Korean Patent Application No. 10-2008-0131667, filed on Dec. 22, 2008 in the Korean Intellectual Property Office, the entire disclosure of which is incorporated herein by reference.

TECHNICAL FIELD

Present disclosure relate generally to a developing unit and an image forming apparatus employing the same, and, more particularly, to a developing unit capable of simpler assembly and an image forming apparatus having the same.

BACKGROUND OF RELATED ART

Image forming apparatuses are apparatuses that form an image on tangible print medium, e.g., paper, according to an input image signal, and may be, for example, a printer, a copier, a fax machine and a so-called multi-functional peripheral that combines some of the functionalities of the aforementioned.

An image forming apparatus generally includes a main body that defines the external appearance of the image forming apparatus and various components supported or accommodated in the main body. Such components may include, for example, a print media supply unit for storing print media, a developing unit for forming an image of developer on a print medium supplied by the print media supply unit, a fusing unit for fixing the developer on the print medium and an exit unit for discharging the print medium, on which the developer image is fixed, outside the main body.

By way of an example, in an image forming apparatus of the above described configuration, a light modulated with image information is irradiated on a photoconductor (often also referred to as "an image carrier" or a "photosensitive member"), the surface of which had been pre-charged to a uniform electrical potential, so as to form an electrostatic latent image on the surface of the photoconductor based on the potential difference resulting from the light exposure. So created electrostatic latent image is then developed into a visible image by applying developer that adhere to selective portions of the surface of the photoconductor due to the potential differences defined by the electrostatic latent image. The visible image of developer is then transferred from the photoconductor onto a print medium supplied from the print media storage unit. The visible image so transferred to the print media is fused or permanently fixed to the print medium using a fusing unit to thereby complete the image formation. After the completion of the image formation, the print medium bearing the fixed developer image is discharged from the main body by an exit unit.

A developing unit of such an image forming apparatus typically includes one or more processing members operable to accomplish the above described formation of a visible image. Examples of such processing members may include, a photoconductor for supporting thereon an electrostatic latent image, a developing body for supplying the developer to the photoconductor so as to form a visible image, a developer storage part to store the developer, a waste developer storage part to store the waste developer that remain residual after a development of an electrostatic latent image, a cleaning unit to clean the waste developer remaining on the photoconductor and a charging unit to charge the surface of the photoconductor to a potential level.

In a developing unit, one or more of the afore-mentioned processing members are supported, in some cases, rotatably, in the frame that defines the external appearance of the developing unit. The frame of the developing unit may include a number of sub-frames. When the sub-frames are not assembled precisely, the positions of the processing members supported by the sub-frames may not be properly aligned, thus possibly resulting in defects in the images. The misalignment of the processing members may also result in the excessive wearing of the processing members due to unintended contacts and/or friction between the processing members, and may even cause the leakage of the developer stored in the developing unit. Assembly of a developing unit may involve steps to ensure sufficient level of precision. Thus, a developing unit capable of being assembled with simpler assembly process is thus desirable.

SUMMARY OF THE DISCLOSURE

In accordance with one aspect of the present invention, a developing unit for developing a latent image using developer in an image forming apparatus may be provided to include a first frame, a second frame, one or more first connection parts and one or more third connection parts provided on the first frame and one or more second connection parts and one or more fourth connection parts provided on the second frame. The first frame may support thereon one or more first processing members operable to assist in developing the latent image. The first frame may include at least one jig hole through which the first frame is capable of being placed on a jig during an assembly of the developing unit. The second frame may support one or more second processing members operable to assist in developing the latent image. The one or more first connection parts may each be configured to be coupled to a respective associated one of the one or more second connection parts. The one or more third connection parts may each be configured to be coupled to a respective associated one of the one or more fourth connection parts. The one or more first connection parts and the one or more second connection parts may move relative to each other in a first movement that includes a rectilinear movement so as to be coupled to one another. The third connection parts and the fourth connection parts may move relative to each other in a second movement that includes a rotational movement so as to be coupled to one another.

The one or more first processing members and the one or more second processing members may include at least one of an image carrier having a surface on which to support a visible image that is formed as a result of developing of the latent image, a charging device configured to charge the surface of the image carrier to an electrical potential, a developing body configured to apply developer on the surface of the image carrier, a regulation member configured to regulate the thickness of the developer on the developing body and a cleaning device configured to remove the developer from the surface of the image carrier.

The one or more third connection parts and the one or more fourth connection parts may be coupled in corresponding pairs after the paired coupling of the one or more first connection parts and the one or more second connection parts.

The one or more first connection parts and the one or more second connection parts may be coupled in such a manner that allows associated ones of the one or more first connection parts and the one or more second connection parts to be rotatable relative to one another. The first frame and the second frame may be moveable, relative to each other so as to be coupled each other, rotationally about the one or more first connection parts and the one or more second connection parts.

Each of the one or more first connection parts may include a through hole through which the respective associated one of the one or more second connection parts is received. Each of the one or more second connection parts may include a locking portion that is configured so as to be receivable into the through hole of the respective associated one of the one or more first connection parts. The locking portion of each of the one or more second connection parts may be configured to be in an interfering contact with portions of the respective associated one of the one or more first connection parts adjacent the through hole.

The one or more third connection parts may each comprise a recess provided in the first frame. The one or more fourth connection parts may each include a locking member extending from the second frame and configured to come into a locking contact with the recess of the respective associated one of the one or more third connection parts.

The one or more first connection parts and the one or more second connection parts may be configured to couple one another in one or more corresponding pairs so as to couple together respective lower portions of the first and second frames. The one or more third connection parts and the one or more fourth connection parts may be configured to couple one another in one or more corresponding pairs so as to couple together respective upper portions of the first and second frames.

The developing unit may include a first number of associated pairs of the one or more first connection parts and the one or more second connection parts and a second number of associated pairs of the one or more third connection parts and the one or more fourth connection parts. The sum of the first number and the second number may be at least three. Each of the first number and the second number may be at least one.

The first frame may define therein a developer storage in which to store the developer. The second frame may include a waste developer storage in which to store waste developer remaining residual after developing of the latent image.

The developing unit may further include a developing support member provided in the first frame. The developing support member may be configured to support both the image carrier and the developing body.

The developing unit may further comprise a developing body support member and an image carrier support member. The developing body support member may be provided in the first frame, and may be configured to support the developing body. The image carrier support member may be provided in the second frame, and may be configured to support the image carrier.

The at least one jig hole may include at least one circular hole each having a circular cross-sectional shape and at least one elongated hole each having an elongated cross-sectional shape.

According to another aspect of the present disclosure an image forming apparatus that includes a developing unit for developing a latent image using developer may be provided to include a first frame of the developing unit, a second frame of the developing unit, one or more first connection parts and one or more third connection parts provided on the first frame and one or more second connection parts and one or more fourth connection parts provided on the second frame. The first frame may support thereon one or more first processing members operable to assist in developing, the latent image. The first frame may include at least one jig hole through which the first frame is capable of being placed on a jig during an assembly of the developing unit. The second frame may support one or more second processing members operable to assist in developing the latent image. The one or more first connection parts may each be configured to be coupled to a respective associated one of the one or more second connection parts. The one or more third connection parts may each be configured to be coupled to a respective associated one of the one or more fourth connection parts. The one or more first connection parts and the one or more second connection parts may move relative to each other in a first movement that includes a rectilinear movement so as to be coupled to one another. The third connection parts and the fourth connection parts may move relative to each other in a second movement that includes a rotational movement so as to be coupled to one another.

According to yet another aspect of the present disclosure, a developing unit that includes processing members operable to develop a latent image using developer into a visible developer image may be provided to include a first sub-frame and a second sub-frame. The first sub-frame may define a first portion of an external appearance of the developing unit. The second sub-frame may define a second portion of the external appearance of the developing unit. The first and second sub-frames may be configured to be in a coupled arrangement with each other so as to together define substantially the external appearance of the developing unit. The coupled arrangement may comprise a first engagement of a first portion of the first sub-frame with a first portion of the second sub-frame and a second engagement of a second portion of the first sub-frame with a second portion of the second sub-frame. The first engagement may result from a rectilinear movement of the first and second sub-frames relative to each other. The second engagement may result from a rotational movement of the first and second sub-frames relative to each other.

The coupled arrangement may comprise the first engagement that occurs prior in time to the second engagement.

The first engagement may restrict a relative movement between the first and second sub-frames in a first direction. The rotational direction of the rotational movement of the first and second sub-frames may be orthogonal to the first direction.

The first engagement may be between a first connection part and a second connection part each provided in a respective corresponding one of the first and second sub-frames. The first connection part may include an opening through which a portion of the second connection part is received. The second engagement may be between a third connection part and a fourth connection part each provided in a respective corresponding one of the first and second sub-frames. The third connection part may comprise a recess in which a protruding portion of the fourth connection part is received.

The processing members may comprise at least two of an image carrier having a surface on which to support the visible developer image, a charging device configured to charge the surface of the image carrier to an electrical potential, a developing body configured to apply developer on the surface of the image carrier, a regulation member configured to regulate the thickness of the developer on the developing body and a cleaning device configured to remove the developer from the surface of the image carrier. The first sub-frame may support thereon a first one of the processing members. The second sub-frame may support thereon a second one different that the first one of the processing members.

BRIEF DESCRIPTION OF THE DRAWINGS

Various aspects of the present disclosure will become apparent and more readily appreciated from the following description of the embodiments, taken in conjunction with the accompanying drawings, in which.

DETAILED DESCRIPTION OF SEVERAL EMBODIMENTS

Figure 1:
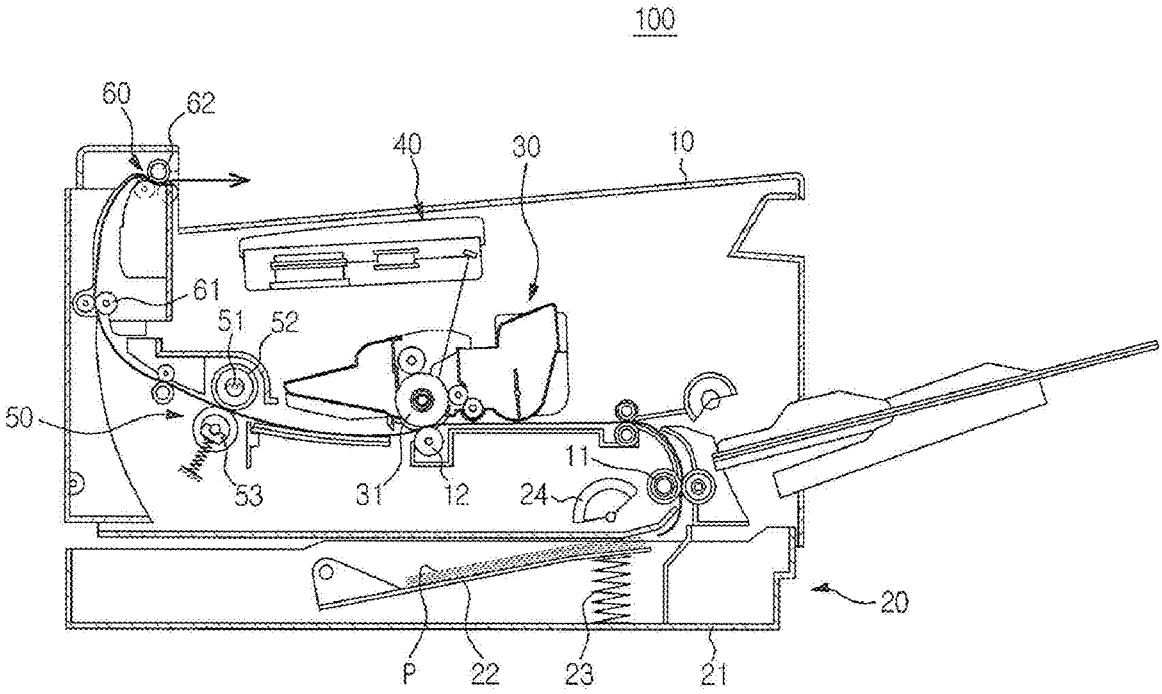
FIG. 1 is a longitudinal cross-sectional view schematically illustrating the configuration of an image forming apparatus in accordance with an embodiment of the present disclosure.

Reference will now be made in detail to several embodiments of the present disclosure, examples of which are illustrated in the accompanying drawings, wherein like reference numerals refer to the like elements throughout. It should be also noted that, in the drawings, the dimensions of the illustrated features are not intended to be to true scale, and may be exaggerated for the sake of allowing greater understanding.

As shown in FIG. 1, an image forming apparatus 100 in accordance with an embodiment may include a main body 10 that defines the overall external appearance of the image forming apparatus 100, a print media supply unit 20 configured to store and to supply print media P to be used in the image forming apparatus 100, a developing unit 30 configured to develop an electrostatic latent image into a visible image using developer, an exposure unit 40 configured to form the electrostatic latent image on a photoconductor 31 of the developing unit 30, a transfer roller 12 configured to cause the visible developer image to be transferred from the developing unit 30 to a print medium P supplied from the print media supply unit 20, a fusing unit 50 configured to fuse the transferred developer image onto the print medium P and an exit unit 60 configured to discharge the print medium P, on which the image formation has been completed, outside the main body 10.

The print media supply unit 20 may include a print media cassette 21 that may be detachable from the main body 10, for example, as a sliding drawer type, to supply the print media P to the developing unit 30. A knock-up plate 22 may be installed in the print media cassette 21, and may allow one or more print media P to be stacked thereupon. A pick-up roller 24 may be configured to pick up the print media P placed on the knock-up plate 22, typically one sheet at a time, and to transmit the picked up print media P toward the developing unit 30. One end of the knock-up plate 22 may be rotatably supported in the print media cassette 21 while the other opposite end of the knock-up plate 22 may be elastically supported by an elastic member 23 that imparts an elastic force on the knock-up plate 22 such that the knock-up plate is elastically biased to rotate around one end thereof. A feed roller 11 to feed the print media P picked up by the pick-up roller 24 further towards the developing unit 30 may further be installed in the main body 10 of the image forming apparatus 100.

The exposure unit 40 may be configured to irradiates light modulated with the image data onto the photo conductor 31, and to thereby forms the electrostatic latent image on the photoconductor 31.

The developing unit 30, which will be further described in greater detail, may be configured to develop the electrostatic latent image of the photoconductor 31 with developer so as to form a visible developer image on the photoconductor 31.

The transfer roller 12 may be an example of a transfer device, and may be configured to cause visible developer image to be transferred from the photoconductor 31 to the print medium P by, e.g., pressing the print medium P against the photoconductor 31 as the print medium P is passing between the photoconductor 31 and the transfer roller 12.

The fusing unit 50 may be configured to fuse or permanently fix the transferred developer image on the print medium P by applying heat and/or pressure. To that end, the fusing unit 50 may include a heating roller 52 that may be provided with a heater 51 installed therein, and a pressure roller 53 arranged to press the print medium P against the heating roller 52. When the print medium P passes through a gap between the heating roller 52 and the pressure roller 53 to thus receive the heat and pressure from the fusing unit 50, the developer in the form of the image is fused to the print medium P.

The exit unit 60 may include a first exit roller 61 and a second exit roller 62, which may be arranged sequentially in the path of the print medium P, and may discharge the print medium P that has passed through the fusing unit 50, out of the main body 10.

Figure 2:
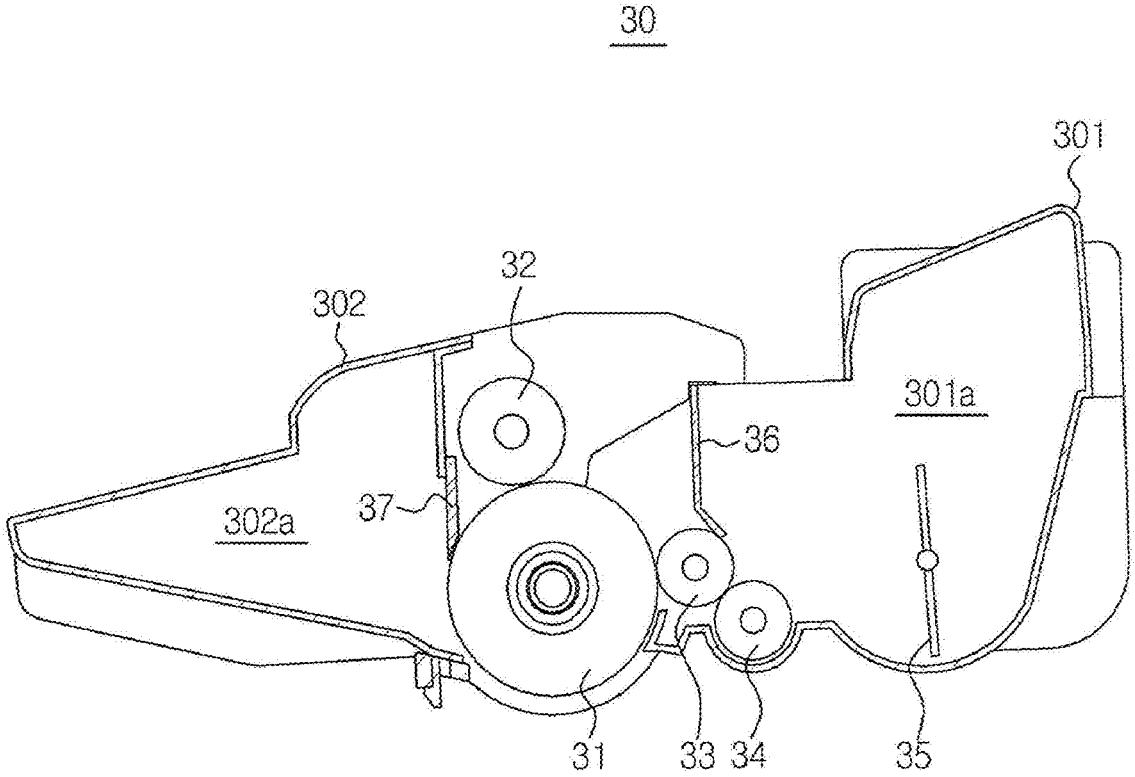
FIG. 2 is a longitudinal cross-sectional view of a developing unit according to an embodiment of the present disclosure.
Figure 3:
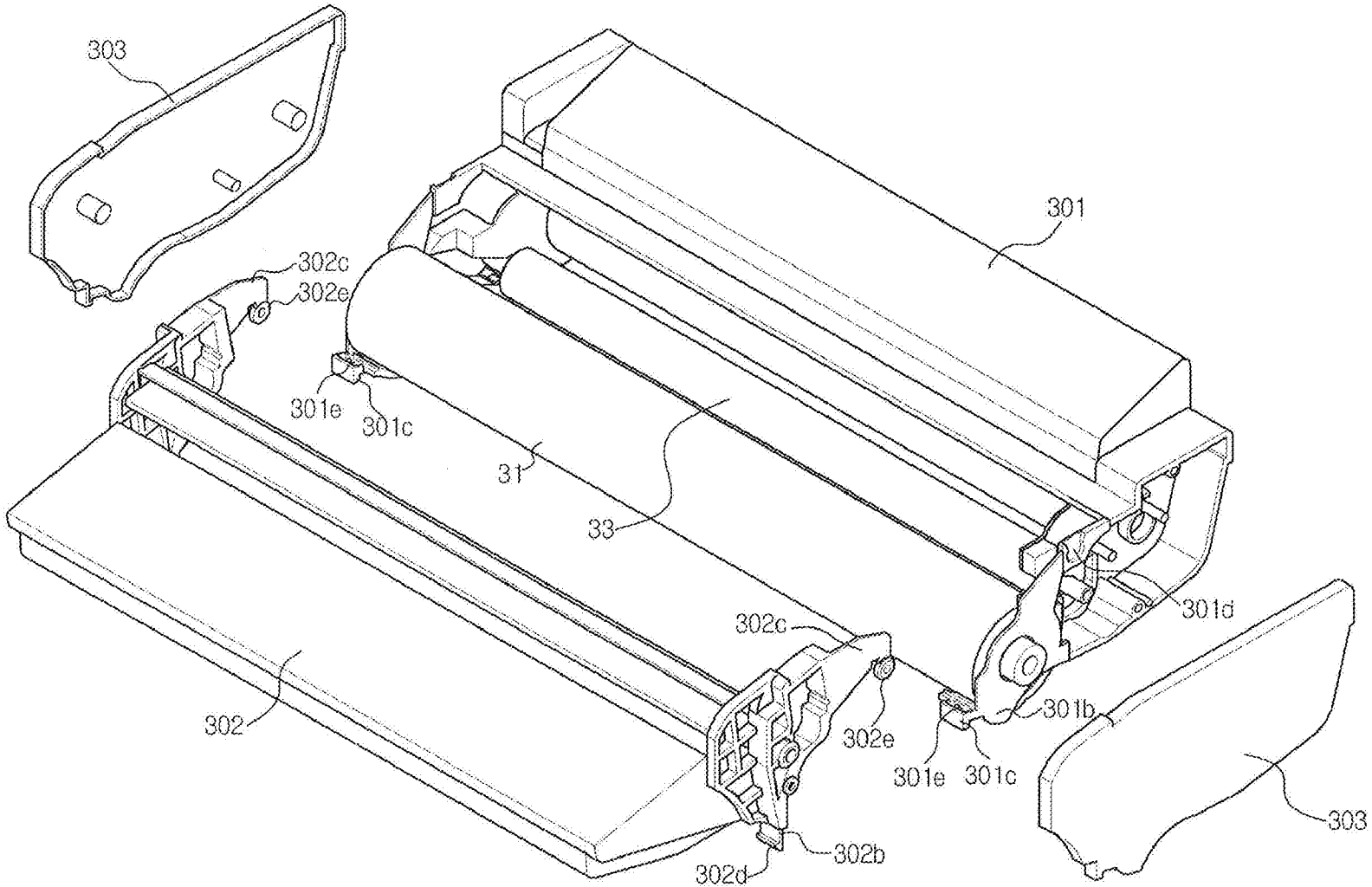
FIG. 3 is an exploded perspective view of a developing unit according to an embodiment of the present disclosure.

The developing unit 30 is configured to develop an electrostatic latent image into a visible image using developer, e.g., toner, which visible image may then be transferred onto a print medium P fed from the print media supply unit 20, and, to that end, may include one or more processing members operable to form the visible toner image. Referring now to FIGS. 2 and 3, the processing members may include one or more of, for example, a photoconductor 31 that functions as an image carrier that supports thereon the visible image formed by developing with the developer the electrostatic latent image that had been formed by the exposure to light from the exposure unit 40 (see FIG. 1), a charging roller 32, which may be an example of a charging device that is configured to charge the photoconductor 31 to an electrical potential, a developing body 33 configured to supply the developer to the photoconductor 31 so as to develop the electrostatic latent image formed on the photo conductor 31 into the visible image, a regulation member 36 that may be configured to regulate the developer carried on the developing body 33 to a uniform thickness, a supply roller 34, which may be an example of a supply device that is configured to supply the developer stored in a developer storage part 301*a* to the developing body 33, and a cleaning blade 37 that may be an example of a cleaning device configured to remove the residual developer remaining on the photoconductor 31, which residual developer may be stored in a waste developer storage part 302*a*.

The developing unit 30 according to an embodiment may include a first frame 301, which may support some of the processing members, and which may define a developer storage part 301*a* to store the developer, and a second frame 302, which may support the remaining ones of the processing members, if any, and which may define the waste developer storage part 302*a* to store the collected waste developer. As shown in FIG. 3, the developing unit 30 may further include the connection brackets 303 that may be installed on one or both ends of the first frame 301 and the second frame 302, and which may be configured to support, and to determine the relative positions of, one or more processing members, that is, at least one of the photoconductor 31, the charging roller 32, the developing body 33, the supply roller 34, the regulation member 36 and the cleaning blade 37. The overall external appearance of the developing unit 30 may be defined by the first frame 301, the second frame 302 and the connection brackets 303. According to an embodiment, one or more developing parts 301*b* may further be provided to support one or both ends of the photoconductor 31 and one or both ends of the developing body 33. The developing parts 301*b* may be formed as integral parts of the first frame 301, for example. An agitator 35 configured to agitate the developer may additionally be provided in the developer storage part 301*a* defined by the first frame 301.

Plural connection parts 301*c*, 301*d*, 302*b* and 302*c* in corresponding association with one another as further described below may be provided on the first frame 301 and the second frame 302, and may limit the relative movements of the first frame 301 and the second frame 302. For example, the first frame 301 and the second frame 302 may be assembled together through coupling between the corresponding ones of the plural connection parts 301*c*, 301*d*, 302*b* and 302*c*, which may allow certain controlled relative movements of the first frame 301 and the second frame 302 during the assembly of the developing unit 30 in such manner as to reduce the manufacturing defects due to the collisions between parts of the developing unit 30 during the relative movements of the first frame 301 and the second frame 302.

The plural connection parts 301*c*, 301*d*, 302*b* and 302*c* according to an embodiment may include one or more first connection parts 301*c* provided at the lower portion of the first frame 301, one or more second connection parts 302*b* provided at the lower portion of the second frame 302 corresponding to the locations of the first connection parts 301*c*, one or more third connection parts 301*d* provided at the upper portion of the first frame 301 and one or more fourth connection parts 302*c* provided at the upper portion of the second frame 302 corresponding to the locations of the third connection parts 301*d*. According to an embodiment, the first connection parts 301*c* and the second connection parts 302*b* may be provided in a paired arrangement where a first connection part 301*c*/second connection part 302*b* pair may be provided at each of the two ends of the lower portions of the first frame 301 and the second frame 302. According to an embodiment, and the third connection parts 301*d* and the fourth connection parts 302*c* are respectively provided in a pair at both sides of the upper portions of the first frame 301 and the second frame 302.

Therefore, the lower portion of the first frame 301 and the lower portion of the second frame 302 are connected through one pair of the first connection parts 301*c* and one pair of the second connection parts 302*b*, and the upper portion of the first frame 301 and the upper portion of the second frame 302 are connected through one pair of the third connection parts 301*d* and one pair of the fourth connection parts 302*c*. That is, the lower portion of the first frame 301 and the lower portion of the second frame 302 are connected at two places through two pairs of the first connection parts 301*c* and the second connection parts 302*b*, and the upper portion of the first frame 301 and the upper portion of the second frame 302 are connected at two places through two pairs of the third connection parts 301*d* and the fourth connection parts 302*c*. Therefore, the first frame 301 and the second frame 302 are connected at a total of four places, and thus the relative movements of the first frame 301 and the second frame 302 are prevented.

Further, the image forming apparatus 100 in accordance with this embodiment is simply assembled without minute adjustment, and thus may be applied to an automation process using a robot.

According to an embodiment, the first assembly procedure in which the first connection parts 301*c* and the second connection parts 302*b* are coupled together and the second assembly procedure in which the third connection parts 301*d* and the fourth connection parts 302*d* are coupled together may be carried out sequentially. That is, as the first assembly process, one or both of the first connection parts 301*c* and the second connection parts 302*b* may move rectilinearly in order to become coupled to each other. Since the first connection parts 301*c* and the second connection parts 302*b* may be coupled in such a manner that the first connection parts 301*c* and the second connection parts 302*b* are rotatable with respect to each other, once the first connection parts 301*c* and the second connection parts 302*b* are so coupled, one or both of the first and second frames 301 and 302 may rotate about the coupling of the first connection parts 301*c* and the second connection parts 302*b* toward the position of coupling together the third connection parts 301*d* and the fourth connection parts 302*c*.

In order to achieve the connections between the third connection parts 301*d* and the fourth connection parts 302*c* through the relative rotational movements of the third connection parts 301*d* and the fourth connection parts 302*c* around the first connection parts 301*c* and the second connection parts 302*b*, through holes 301*e*, through which the second connection parts 302*b* enters, may be formed in the first connection parts 301*c*, and first locking pieces 302*d*, which enters through the through holes 301*e*, and which may be supported by portions of the first connection parts 301*c* adjacent to the through holes 301*e*, may be formed on the second connection parts 302*b*. The third connection parts 301*d* may be formed as recesses of both side surfaces of the first frame 301 into which the fourth connection parts 302*c* may be received. The fourth connection parts 302*c* may each be provided with a second locking piece 302*e*, which may extend from the second frame 302, and which is may be inserted into a third connection part 301*d*.

Figure 5:
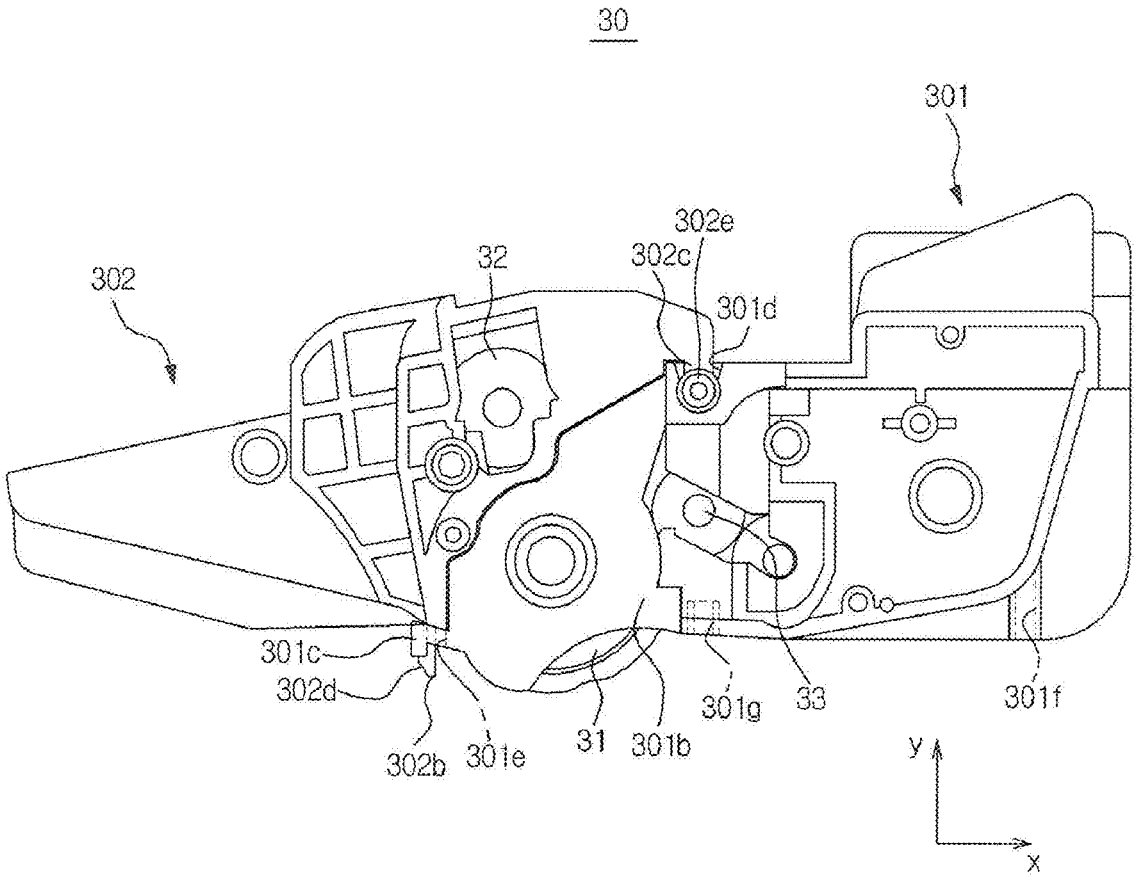

For example, referring to FIG. 5, the first locking pieces 302*d* of the second connection parts 302*b* may be received through the through holes 301*e* of the first connection parts 301*c*, and may be supported by the portions of the first connection parts 301*c* adjacent the through holes 301*e*. Accordingly, the first connection parts 301*c* and the second connection parts 302*b* become coupled to each other in such a manner that the first connection parts 301*c* and the second connection parts 302*b* may be rotatable within a range of rotational angles. As shown in FIG. 5, the second locking pieces 302*e* of the fourth connection parts 302*c* may be arranged at a position on the second frame 302 so as to allow the second locking piece 302*e* to be received into the third connection parts 301*d* as the first frame 301 and the second frame 302 rotate relative to one another around the coupling of the first connection parts 301*c* and the second connection parts 302*b*. The coupling of the third connection parts 301*d* and the fourth connection parts 302*c* may thus become simple.

That is, once the couplings of the first connection parts 301*c* and the second connection parts 302*b* are carried out with sufficient precision, the coupling of the third connection parts 301*d* and the fourth connection parts 302*c* may be achieved without requiring minute adjustment(s). Thus, the assembly of the first frame 301 and the second frame 302 can be suitable for automation, e.g., using a robot.

Figure 6:
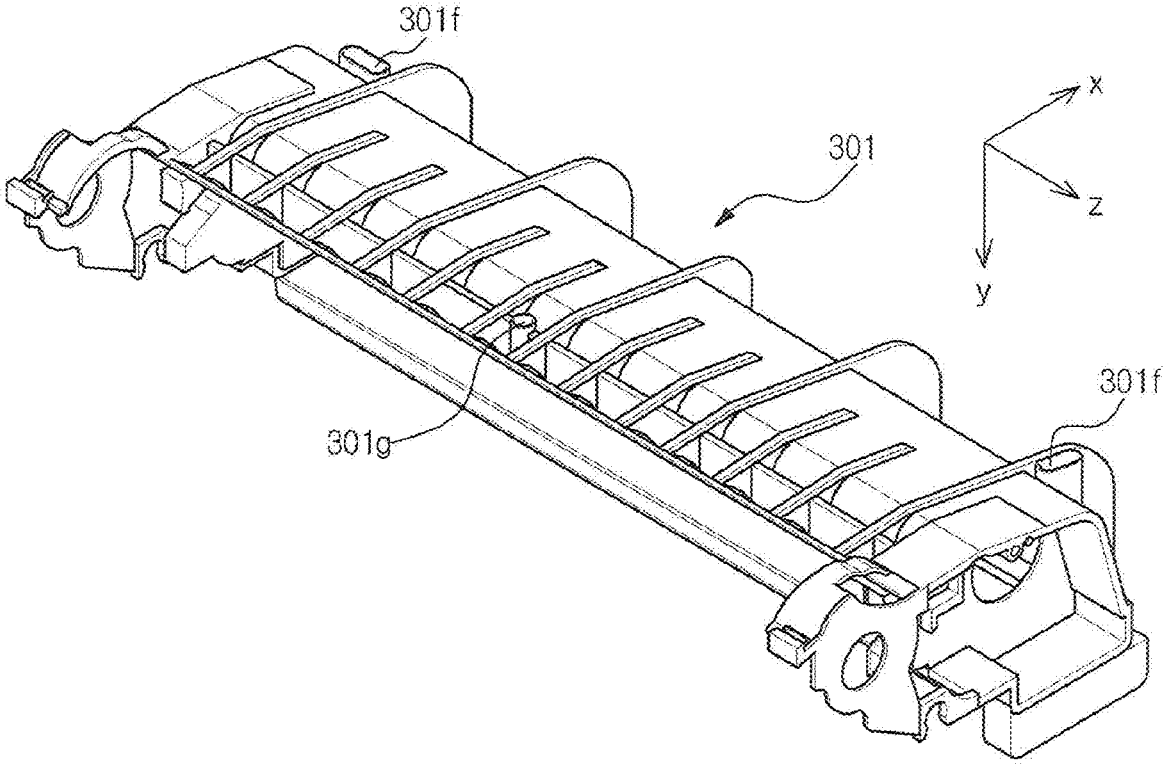
FIG. 6 is a perspective view illustrating the bottom surface of a relevant portion of the first frame of a developing unit according to an embodiment of the present disclosure.

By way of an example, for automation of the assembly of the first frame 301 and the second frame 302, as illustrated in FIG. 6, one or more of jig holes 301*f* and 301*g* may be provided, e.g., on the lower surface of the first frame 301 of the developing unit 30. The jig holes may be utilized in fixing the first frame 301 (or the second frame 302 as the case may be when the jig holes are provided on the second frame 302) to a jig or jigs (not shown) to limit the movement of the first frame 301 during the assembly process of the developing unit 30. In the example shown in FIG. 6, the jig holes 301*f* and 301*g* are provided in plural numbers to stably maintain the developing unit 30 in the state fixed to the jigs, for example, during the process of assembly and/or filling of developer in the developing unit 30 for storage. The jig holes 301*f* and 301*g* according to an embodiment may include a pair of first jig holes 301*f*, which may be elongated holes provided at both sides of the lower surface of the first frame 301. The second jig hole 301*g* may be a circular hole. The first jig holes 301*f* and the second jig hole 301*g* may collectively serve to fix the first frame 301 (or the second frame 302 as the case may be) to the jigs under the condition that the first frame 301 is supported at three points. According to an embodiment, one of the first jig holes 301*f* may be elongated extending in the width direction of the developing unit 30, i.e., the direction of the z-axis, while the other one of the first jig holes 301*f* may be elongated in the length direction of the developing unit 30, i.e., the direction of the x-axis. In FIG. 6, the direction of the y-axis correspond to the height direction of the developing unit 30.

The process of assembling the first frame 301 and the second frame 302 according to an embodiment will be described in greater detail below.

First, the first frame 301 may be placed on the jigs through the first jig holes 301*f* and the second jig hole 301*g* so as to restrict the movement of the first frame 301. With the first frame 301 on the jig, the second frame 302 may be assembled with the first frame 301.

Figure 4:
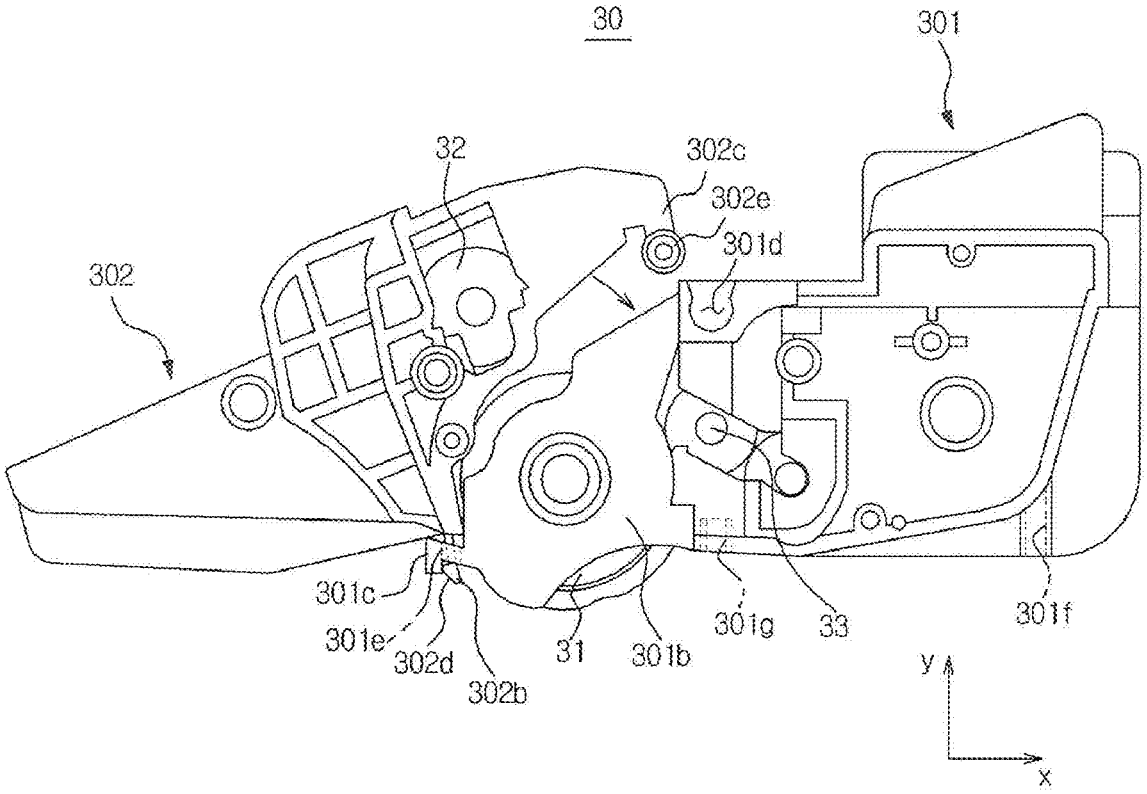
FIGS. 4 and 5 are side views illustrating a process of assembly of a developing unit according to an embodiment of the present disclosure.

During the first assembly procedure, in which the first connection parts 301*c* and the second connection parts 302*b* may be coupled together, the first frame 301 may move substantially in a straight line along the direction of the y-axis as shown in FIG. 4 such that the assembly may be carried out by the relative rectilinear movement of the first connection parts 301*c* and the second connection parts 302*b*. While, in this example, in which the first frame 301 is supported by the jigs in the direction of the y-axis through the first jig holes 301*f* and the second jig hole 301*g*, the assembly of the first frame 301 and the second frame 302 is described as being achieved through a rectilinear movement of the second frame 302 in the direction of the y-axis, it should be noted that, in alternative embodiments, the assembly of the first frame 301 and the second frame 302 may be achieved by a rectilinear movement of the first frame 301 or by movements of one or both of the first and second frames 301 and 302 in various other directions according to various shapes of the first connection parts 301*c* and the second connection parts 302*b* employed, including, for example, rectilinear movement(s) along the x-axis or the x-axis.

After the first assembly procedure has been completed, the second assembly procedure, in which the third connection parts 301*d* and the fourth connection parts 302*d* are coupled, may be carried out. In the examples illustrated in FIGS. 4 and 5, after the first connection parts 301*c* and the second connection parts 302*b* are properly coupled together, the second frame 302 may move only across the x-y plane as the movement of the second frame 302 in the direction of the z-axis may be restricted by coupling of the first connection parts 301*c* and the second connection part 302*b*. With the movement of second frame 302 in the x-y plane, e.g., rotational movement of the second frame 302 about the coupling of the first connection parts 301*c* and the second connection part 302*b*, the coupling between the third connection parts 301*d* and the fourth connection parts 302*c* may be achieved. That is, during the second assembly procedure, according to this example, the second frame 302 may rotate about the first connection parts 301*c* and the second connection parts 302*b* across the x-y plane in the rotational direction such that the third connection parts 301*d* and the fourth connection parts 302*c* may become coupled as shown in FIG. 5. Since the movement of the first frame 301 in the direction of the x-axis can be restricted by the jigs during the process of rotating the second frame 302, some or most of the force that may be applied during the coupling of the third connection parts 301*d* and the fourth connection parts 302*c* may be absorbed by the jigs through the first jig holes 301*f* and the second jig hole 301*g*.

The first frame 301 and the second frame 302 are assembled together upon the completion of the above described first and second assembly procedures. As described above, the first frame 301 and the second frame 302 may move relatively to each other within a range of motion based on the coupling movements of the connection parts 301*c*, 301*d*, 302*b* and 302*c*. During such process of assembling the first frame 301 and the second frame 302, the movements of the above-described processing members, for example, in the examples shown in FIGS. 2-5, the photo conductor 31, the developing body 33, the supply roller 34 and the regulation member 36 each supported on the first frame 301 as well as the cleaning blade 37 and the charging roller 32 that are supported on the second frame 302, may be controlled so as to prevent the interferences or undesirable contacts between the processing members. In particularly, the movements of the processing members along the x-axis and y-axis directions may be restricted.

After the completion of the above-described first and second assembly procedures, the connection brackets 303 may be installed on both side ends of the first frame 301 and the second frame 302 so as to regulate the position of at least one of the processing members. That is, as the movements of the processing members in the direction of the x-axis and the direction of the y-axis may be restricted during the first and second assembly procedures described above, the connection brackets 303 when installed may restrict the movements of one or more of the processing members in the direction of the z-axis.

Although in the embodiments described above both of the first and second assembly procedures are described as involving the relative movements of the second frame 302 across the x-y plane, while the movement of the first frame 301 in the z-axis direction is restricted, the directions of allowed movements and of restricted movements need not be limited to the particular directions described. That is, the second frame 302 may move during the second assembly procedure in a plane formed by any directions that is not the direction of movement restricted during the first assembly procedure. For example, according to alternative embodiments, the movement of the second frame 302 in the direction of the x-axis may be restricted during the first assembly procedure while the second frame 302 may move in the y-z plane during the second assembly procedure, or the movement of the second frame 302 in the direction of the y-axis may be restricted during the first assembly procedure while the second frame 302 may move in the x-z plane during the second assembly procedure.

Further, while in the embodiments described above, the first assembly procedure is described to involve a rectilinear movement of the second frame 302 while the second assembly procedure is described to involve a rotational movement of the second frame 302, the first and second assembly procedures need not be limited to such order or movements. That is, for example, in alternative embodiments, the first assembly procedure may be achieved by a rotational movement of the second frame 302 while the second assembly procedure may be achieved by a rectilinear movement of the second frame 302.

Figure 7:
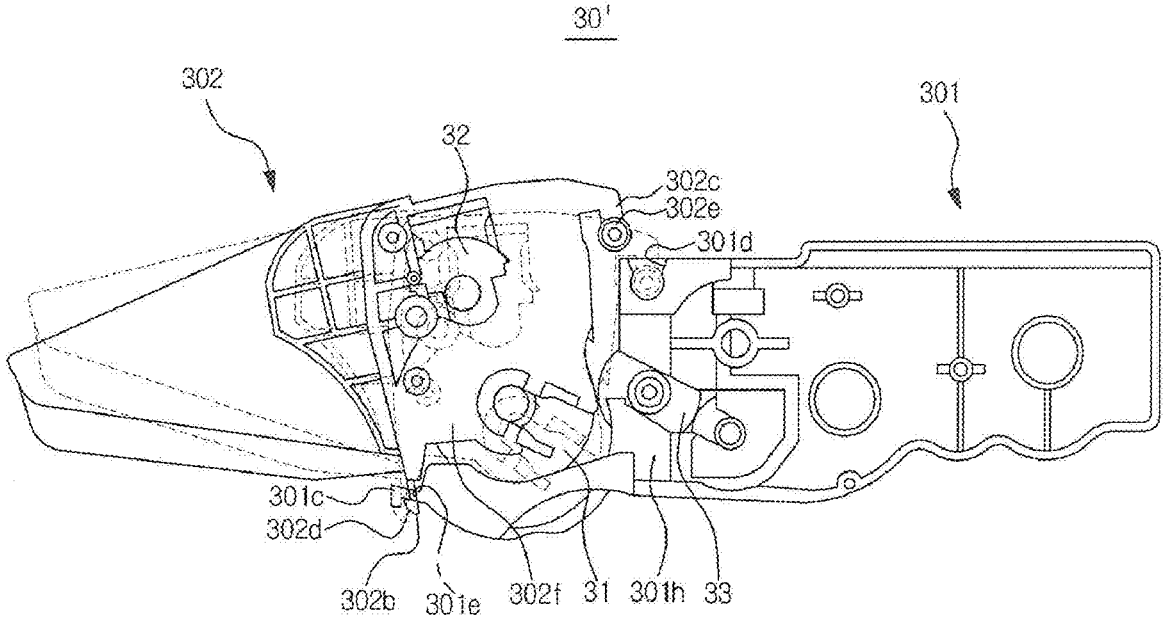
FIG. 7 is a side view illustrating a process of assembly of a developing unit according to another embodiment of the present disclosure.

It should also be noted that while in the embodiments described above, the developing parts 301*b* is provided on the first frame 301 to support both the photoconductor 31 and the developing body 33, as, for example, shown in FIG. 7, a developing unit 30' according to another embodiment may include one or more developing body installation parts 301*h* provided in the first frame 301 and one or more photoconductor installation parts 302*f* provided in the second frame 302 to support the developing body 33 and the photoconductor 31, respectively. According to an embodiment, developing body installation parts 301*h* may be formed integrally with the first frame 301, and/or the photo conductor installation parts 302*f* may be formed integrally with the second frame 302. With such configuration, the developing body 33 may be installed on the first frame 301 through the developing body installation parts 301*h* while the photoconductor 31 may be installed on the second frame 302 through the photoconductor installation parts 302*f*.

Although in the embodiments described above, two coupled pairs of the first connection parts 301*c* and the second connection parts 302*b* and two coupled pairs of the third connection parts 301*d* and the fourth connection parts 302*c* are described as providing the coupling of the first frame 301 and the second frame 302 in a total of four places, the number of the connection parts 301*a*, 302*b*, 301*d* and 302*c* need not be limited to that described in such embodiments. That is, even with less number of coupled pairs of the connection parts 301*a*, 302*b*, 301*d* and 302*c*, for example, with only three coupled pairs that provides a three-point support, a sufficiently stable coupling of the first frame 301 and the second frame 302 may still be possible. According to an embodiment, it may be preferable to provide couplings of at least three pairs the connection parts, for example, at least one coupled pair of the first and second connection parts 301*a* and 302*b* and at least two coupled pairs of the third and fourth connection parts 301*d* and 302*c* or at least one coupled pair of the third and fourth connection parts 301*d* and 302*c* and at least two coupled pairs of the first and second connection parts 301*a* and 302*b*.

According to one aspect of the present disclosure, a developing unit and an image forming apparatus employing such developing unit consistent with one or more embodiments include first connection part(s) and second connection part(s) that are firstly coupled and third connection part(s) and fourth connection part(s) that subsequently become coupled. With such configuration, for example, the respective lower portions of the first and second frames may provide movement restrictive support during the coupling of the respective upper portions of the first and second frames so as to limit the relative movements of the first frame and the second frame, thus reducing the likelihood of a failure that may occur due to the relative movements of the first and second frames during assembling of the developing unit.

According to an aspect of the present disclosure, the rotatable coupling of the lower portions of the first and second frames advantageously allow the relative rotational movement of the first frame and second frame along a predictable rotational path that enables the coupling of the upper portions of the first and second frames. Therefore, the coupling of the first and second frames can be simplified, and can thus be automated.

While several embodiments of the present disclosure have been shown and described, it would be appreciated by those skilled in the art that various modifications to, and variations of, these embodiments may be made without departing from the principles and spirit of aspects of the present disclosure, the scope of which is defined in the claims and their equivalents.

What is claimed is:

1. A developing unit for developing a latent image using developer in an image forming apparatus, comprising:

a first frame supporting thereon one or more first processing members operable to assist in developing the latent image, the first frame including at least one jig hole through which the first frame is capable of being placed on a jig during an assembly of the developing unit;

a second frame supporting one or more second processing members operable to assist in developing the latent image;

one or more first connection parts and one or more third connection parts provided on the first frame; and one or more second connection parts and one or more fourth connection parts provided on the second frame, the one or more first connection parts each being configured to be coupled to a respective associated one of the one or more second connection parts, the one or more third connection parts each being configured to be coupled to a respective associated one of the one or more fourth connection parts, wherein the one or more first connection parts and the one or more second connection parts move relative to each other in a first movement that includes a rectilinear movement so as to be coupled to one another, the third connection parts and the fourth connection parts move relative to each other in a second movement that includes a rotational movement so as to be coupled to one another, wherein the first frame is provided with at least one jig hole configured to regulate movements of the first frame during an assembly of the developing unit.

2. The developing unit according to claim 1, wherein the one or more first processing members and the one more second processing members include at least one of an image carrier having a surface on which to support a visible image that is formed as a result of developing of the latent image, a charging device configured to charge the surface of the image carrier to an electrical potential, a developing body configured to apply developer on the surface of the image carrier, a regulation member configured to regulate the thickness of the developer on the developing body and a cleaning device configured to remove the developer from the surface of the image carrier.

3. The developing unit according to claim 2, wherein the one or more third connection parts and the one or more fourth connection parts are coupled in corresponding pairs after a paired coupling of the one or more first connection parts and the one or more second connection parts.

4. The developing unit according to claim 3, wherein the one or more first connection parts and the one or more second connection parts are coupled in such a manner that allows associated ones of the one or more first connection parts and the one or more second connection parts to be rotatable relative to one another, and wherein the first frame and the second frame are moveable, relative to each other so as to be coupled each other, rotationally about the one or more first connection parts and the one or more second connection parts.

5. The developing unit according to claim 2, wherein each of the one or more first connection parts includes a through hole through which the respective associated one of the one or more second connection parts is received, and wherein each of the one or more second connection parts includes a locking portion that is configured so as to be receivable into the through hole of the respective associated one of the one or more first connection parts, the locking portion of each of the one or more second connection parts being configured to be in an interfering contact with portions of the respective associated one of the one or more first connection parts adjacent the through hole.

6. The developing unit according to claim 2, wherein the one or more third connection parts each comprises a recess provided in the first frame, and wherein the one or more fourth connection parts each includes a locking member extending from the second frame and configured to come into a locking contact with the recess of the respective associated one of the one or more third connection parts.

7. The developing unit according to claim 2, wherein the one or more first connection parts and the one or more second connection parts are configured to couple one another in one or more corresponding pairs so as to couple together respective lower portions of the first and second frames, and wherein the one or more third connection parts and the one or more fourth connection parts are configured to couple one another in one or more corresponding pairs so as to couple together respective upper portions of the first and second frames.

8. The developing unit according to claim 2, wherein the developing unit includes a first number of associated pairs of the one or more first connection parts and the one or more second connection parts and a second number of associated pairs of the one or more third connection parts and the one or more fourth connection parts, a sum of the first number and the second number being at least three, each of the first number and the second number being at least one.

9. The developing unit according to claim 2, wherein the developing unit includes a developing support member provided in the first frame and configured to support both the image carries and the developing body.

10. The developing unit according to claim 2, wherein the developing unit further comprises:

a developing body support member provided in the first frame and configured to support the developing body; and an image carrier support member provided in the second frame and configured to support the image carrier.

11. The developing unit according to claim 1, wherein the first frame defines therein a developer storage in which to store the developer; and wherein the second frame includes a waste developer storage in which to store waste developer remaining residual after developing of the latent image.

12. The developing unit according to claim 1, wherein the at least one jig hole includes at least one circular hole each having a circular cross-sectional shape and at least one elongated hole each having an elongated cross-sectional shape.

13. An image forming apparatus having a developing unit for developing a latent image using developer, comprising:

a first frame of the developing unit supporting thereon one or more first processing members operable to assist in developing the latent image, the first frame including at least one jig hole through which the first frame is capable of being placed on a jig during an assembly of the developing unit;

a second frame of the developing unit supporting one or more second processing members operable to assist in developing the latent image;

one or more first connection parts and one or more third connection parts provided on the first frame; and one or more second connection parts and one or more fourth connection parts provided on the second frame, the one or more first connection parts each being configured to be coupled to a respective associated one of the one or more second connection parts, the one or more third connection parts each being configured to be coupled to a respective associated one of the one or more fourth connection parts, wherein the one or more first connection parts and the one or more second connection parts move relative to each other in a first movement that includes a rectilinear movement so as to be coupled to one another, the third connection parts and the fourth connection parts move relative to each other in a second movement that includes a rotational movement so as to be coupled to one another, wherein the first frame is provided with at least one jig hole configured to regulate movements of the first frame during an assembly of the developing unit.

14. The image forming apparatus according to claim 13, wherein the one or more first processing members and the one or more second processing members include at least one of an image carrier having a surface on which to support a visible image that is formed as a result of developing of the latent image, a charging device configured to charge the surface of the image carrier to an electrical potential, a developing body configured to apply developer on the surface of the image carrier, a regulation member configured to regulate the thickness of the developer on the developing body and a cleaning device configured to remove the developer from the surface of the image carrier.

15. The image forming apparatus according to claim 14, wherein the one or more third connection parts and the one or more fourth connection parts are coupled in corresponding pairs after a paired coupling of the one or more first connection parts and the one or more second connection parts.

16. The image forming apparatus according to claim 15, wherein the one or more first connection parts and the one or more second connection parts are coupled in such a manner that allows associated ones of the one or more first connection parts and the one or more second connection parts to be rotatable relative to one another, and wherein the first frame and the second frame are moveable, relative to each other so as to be coupled each other, rotationally about the one or more first connection parts and the one or more second connection parts.

17. The image forming apparatus according to claim 15, wherein each of the one or more first connection parts includes a through hole through which the respective associated one of the one or more second connection parts is received, and wherein each of the one or more second connection parts includes a locking portion that is configured so as to be receivable into the through hole of the respective associated one of the one or more first connection parts, the locking portion of each of the one or more second connection parts being configured to be in an interfering contact with portions of the respective associated one of the one or more first connection parts adjacent the through hole.

18. The image forming apparatus according to claim 14, wherein the one or more third connection parts each comprises a recess provided in the first frame, and wherein the one or more fourth connection parts each include a locking member extending from the second frame and configured to come into a locking contact with the recess of the respective associated one of the one or more third connection parts.

19. The image forming apparatus according to claim 14, wherein the one or more first connection parts and the one or more second connection parts are configured to couple one another in one or more corresponding pairs so as to couple together respective lower portions of the first and second frames, and wherein the one or more third connection parts and the one or more fourth connection parts are configured to couple one another in one or more corresponding pairs so as to couple together respective upper portions of the first and second frames.

20. The image forming apparatus according to claim 13, wherein the first frame defines therein a developer storage in which to store the developer; and wherein the second frame includes a waste developer storage in which to store waste developer remaining residual after developing of the latent image.

21. A developing unit having processing members operable to develop a latent image using developer into a visible developer image, comprising:

a first sub-frame defining a first portion of an external appearance of the developing unit; and a second sub-frame defining a second portion of the external appearance of the developing unit, the first and second sub-frames being configured to be in a coupled arrangement with each other so as to together define substantially the external appearance of the developing unit, wherein, the coupled arrangement comprises a first engagement of a first portion of the first sub-frame with a first portion of the second sub-frame and a second engagement of a second portion of the first sub-frame with a second portion of the second sub-frame, and wherein the first engagement results from a rectilinear movement of the first and second sub-frames relative to each other, the second engagement resulting from a rotational movement of the first and second sub-frames relative to each other, wherein the first sub-frame is provided with at least one jig hole configured to regulate movements of the first sub-frame during an assembly of the developing unit.

22. The developing unit of claim 21, wherein the coupled arrangement comprises the first engagement that occurs prior in time to the second engagement.

23. The developing unit of claim 22, wherein the first engagement restricts a relative movement between the first and second sub-frames in a first direction, a rotational direction of the rotational movement of the first and second sub-frames being orthogonal to the first direction.

24. The developing unit of claim 22, wherein the first engagement is between a first connection part and a second connection part each provided in a respective corresponding one of the first and second sub-frames, the first connection part including an opening through which a portion of the second connection part is received, and wherein the second engagement is between a third connection part and a fourth connection part each provided in a respective corresponding one of the first and second sub-frames, the third connection part comprising a recess in which a protruding portion of the fourth connection part is received.

25. The developing unit of claim 22, wherein the processing members comprise at least two of an image carrier having a surface on which to support the visible developer image, a charging device configured to charge the surface of the image carrier to an electrical potential, a developing body configured to apply developer on the surface of the image carrier, a regulation member configured to regulate the thickness of the developer on the developing body and a cleaning device configured to remove the developer from the surface of the image carrier, and wherein the first sub-frame supports thereon a first one of the processing members, the second sub-frame supporting thereon a second one different that the first one of the processing members.

* * * * *